US006431885B1

(12) United States Patent
Stroup

(10) Patent No.: US 6,431,885 B1
(45) Date of Patent: Aug. 13, 2002

(54) ELECTRICAL COMPONENT GROUNDING DEVICE, ELECTRICAL SYSTEM GROUNDING AND SUPPORT APPARATUS, AND ANTENNA COMPONENT GROUNDING SYSTEM

(75) Inventor: Paul Stroup, Ft. Lauderdale, FL (US)

(73) Assignee: X-Com Systems, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/605,549

(22) Filed: Jun. 27, 2000

(51) Int. Cl.[7] ..... H01R 4/66

(52) U.S. Cl. ..... 439/94; 439/532; 439/798; 174/78

(58) Field of Search ..... 439/92, 94 I, 100, 439/532, 797, 798; 174/78, 75 C, 88 C

(56) References Cited

U.S. PATENT DOCUMENTS

| | | | | | |
|---|---|---|---|---|---|
| 4,270,019 | A | * | 5/1981 | Thye et al. | 174/32 |
| 4,345,294 | A | | 8/1982 | Forberg et al. | 361/119 |
| 4,405,187 | A | | 9/1983 | Müller et al. | 339/14 R |
| 4,420,792 | A | | 12/1983 | Hegner et al. | 361/331 |
| 4,541,682 | A | | 9/1985 | Gerke et al. | 339/111 |
| 4,875,864 | A | | 10/1989 | Campbell | 439/100 |
| 5,094,622 | A | * | 3/1992 | Auclair | 439/92 |
| 5,154,385 | A | * | 10/1992 | Lindberg et al. | 248/225 |
| 5,336,100 | A | * | 8/1994 | Gabrius et al. | 439/115 |
| 5,531,617 | A | * | 7/1996 | Marks | 439/723 |
| 5,616,036 | A | | 4/1997 | Polidori | 439/100 |
| 5,634,827 | A | | 6/1997 | Francois et al. | 439/799 |
| 5,704,805 | A | * | 1/1998 | Douty et al. | 439/532 |
| 5,829,992 | A | | 11/1998 | Merker et al. | 439/98 |
| 5,888,104 | A | | 3/1999 | Mello et al. | 439/785 |
| 5,911,585 | A | | 6/1999 | Zwit | 439/100 |
| 5,929,383 | A | | 7/1999 | Marik et al. | 174/78 |
| 6,106,341 | A | * | 8/2000 | Leach, III | 439/798 |
| 6,188,020 | B1 | * | 2/2001 | Osterbrock et al. | 174/51 |

* cited by examiner

*Primary Examiner*—Tulsidas Patel
*Assistant Examiner*—Thanh-Tam Le
(74) *Attorney, Agent, or Firm*—Wells St. John P.S.

(57) ABSTRACT

An electrical component grounding device includes a ground bar, a fastener, and an elongate backing plate. The ground bar includes an elongate electrical contact bridge having at least one electrical contact, a retainer bracket angularly depending centrally of the bridge, and a fastener receiver. The fastener communicates with the ground bar via the fastener receiver. The elongate backing plate has a fastener receiver mating with the fastener and is operative to engage together the ground bar and the backing plate about a support structure. The backing plate and the fastener further cooperate to support the backing plate for rotatable positioning relative to the ground bar to facilitate assembly of the grounding device to the support structure.

38 Claims, 10 Drawing Sheets

ELECTRICAL COMPONENT GROUNDING DEVICE, ELECTRICAL SYSTEM GROUNDING AND SUPPORT APPARATUS, AND ANTENNA COMPONENT GROUNDING SYSTEM

TECHNICAL FIELD

This invention pertains to electrical grounding systems, including metallic and/or antenna support cable structures, ground planes, and brackets. More particularly, this invention relates to an electrical grounding bracket, otherwise referred to as a ground bar or earth bar, that is attached to a support structure such as a mast antenna or a ladder ground kit or is used as a connection device in order to ground cables or wires to any metallic or electrically conductive bracket and/or support structure.

BACKGROUND OF THE INVENTION

Mounting systems for grounding electrical system connectors and components have been known in the art in order to mitigate possible damaging effects resulting from electrostatic discharge or lightning and mitigate possible damaging effects and/or electrical noise resulting from electrical discharge or lightning. For example, grounding clamps have been used to ground coaxial cable junction boxes to tubular grounding members, such as an electrical service conduit. Numerous other grounding clamps are known in the art.

One particular application requiring improvements is the mounting and grounding of wireless telecommunications antenna system components. Typical antenna installations are generally crowded due to the limited availability of towers and antenna masts upon which such antennas are mounted. For example, the availability of antenna sites has recently been restricted due to zoning laws and limited availability of antenna tower locations which has crowded existing towers with a large number of antennas and associated antenna system components. One particular problem resulting from antenna tower crowding is the limited space available to ground and support electrical cables and components that are associated with an antenna tower. In one case, there exists a need for a ground bar that can be mounted to both c-profiles and cable ladders for grounding and supporting wireless communication networks and/or systems which include, but are not limited to, Groupe Speciale Mobile (GSM) and microwave (MW) cable and antenna system components.

For example, as seen in the prior art apparatus depicted in FIG. 2, a signal carrying cable is supported and grounded using a ground bar 34 mounted along a c-profile 31 that is typically provided at the base of an antenna mast. However, such ground bar 34 is supported at opposite ends in a manner that is axially aligned atop c-profile 31 which necessitates placement of bar 34 directly on top of c-profile 31. Such placement takes a considerable amount of space atop c-profile 31, thereby reducing the overall space available along c-profile 31.

As shown in FIG. 2, ground bar 34 includes a plurality of apertures 36 sized for receiving fasteners that connect with ground wires of an antenna electrical system. Accordingly, a total of ten different ground wires can be connected to ground bar 34, thereby grounding such ground wires onto c-profile 31. Additionally, end slots 38 are provided at each end of ground bar 34. Each fastener 40 cooperates with a retaining washer 42 and a lock washer 44 via a nut (not shown) wherein washer 42 and bar 34 cooperate in fastened assembly to capture bar 34 11 about the open slot of c-profile 31.

However, ground bar 34 takes up a relatively large footprint on a c-profile, thereby significantly reducing the available room for securing additional ground bars or other components. Additionally, ground bar 34 is sized only for mounting on one specific size of c-profile. Furthermore, ground bar 34 cannot be easily or efficiently mounted onto cable ladders.

Furthermore, for cases where there is limited mounting space (i.e., availability of c-profiles), there exists a need for a mounting structure that takes up less space than ground bar 34 along a mounting structure. Furthermore, there exists a need for a ground bar that is capable of being mounted in several different configurations on several different types of electrically conductive support structures of an antenna system. Such a ground bar will reduce the need for several different types of ground bar designs and/or mounting brackets.

SUMMARY OF THE INVENTION

An electrical ground assembly, or grounding device, is provided for mounting and grounding electrical components of a communication device to a support structure such as an antenna tower or a ladder and/or rail structure associated with an antenna tower or other support structure. Hardware dead ends and junction points are grounded to mitigate electrical noise, to protect personnel, to provide electrical grounding protection, and to provide lightning surge protection. Typically, multiple grounds are provided along components and cable shields of a communication device. The grounding device is versatile and adaptable to facilitate mounting to a support structure in a variety of mounting configurations, and while reducing the amount of mounting space needed for securement to the support structure. Furthermore, two different embodiments are provided in order to accommodate grounding of varying amounts of electrical components to a single grounding device.

According to one aspect, an electrical component grounding device includes a ground bar, a fastener, and an elongate backing plate. The ground bar includes an elongate electrical contact bridge having at least one electrical contact, a retainer bracket angularly depending centrally of the bridge, and a fastener receiver. The fastener communicates with the ground bar via the fastener receiver. The elongate backing plate has a fastener receiver mating with the fastener and operative to engage together the ground bar and the backing plate about a support structure. The backing plate and the fastener further cooperate to support the backing plate for rotatable positioning relative to the ground bar to facilitate assembly of the grounding device to the support structure.

According to another aspect, an electrical system grounding and support apparatus includes an electrically conductive grounding bracket and a fastener. The electrically conductive grounding bracket includes an elongate cross-member having a plurality of electrical contacts for receiving ground wires and a mounting tab depending from the cross-member. The fastener cooperates with the grounding bracket to secure the grounding bracket in an electrically conductive relation with a ground support structure. The tab cooperates in assembly with the support structure to resist rotation of the grounding bracket on the support structure.

According to yet another aspect, an antenna component grounding system includes a ground bar and a retainer plate. The ground bar has an elongate electrical contact portion for providing electrical contact for an antenna component and a mounting portion depending from the electrical contact portion for retaining the ground bar to an electrically conductive support structure. The retainer plate is carried by the ground bar. The ground bar and the retainer plate cooperate to capture a support structure therebetween such that the support structure carries the grounding system.

BRIEF DESCRIPTION OF THE DRAWINGS

Preferred embodiments of the invention are described below with reference to the following accompanying drawings.

FIG. 7 is an enlarged perspective view of a second grounding device, similar to the grounding device of FIGS. 3–6, showing a third mounting configuration on an end portion of a c-profile.

FIG. 14 is an elevational view of the grounding device of FIG. 13 showing completed assembly of the grounding device onto the c-profile.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention. Two exemplary implementations are described below and depicted with reference to the drawings comprising two distinct ground bars for an antenna component grounding system, shown in three distinct mounting configurations. While the invention is described by way of a preferred embodiment, it is understood that the description is not intended to limit the invention to these embodiments, but is intended to cover alternatives, equivalents, and modifications such as are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
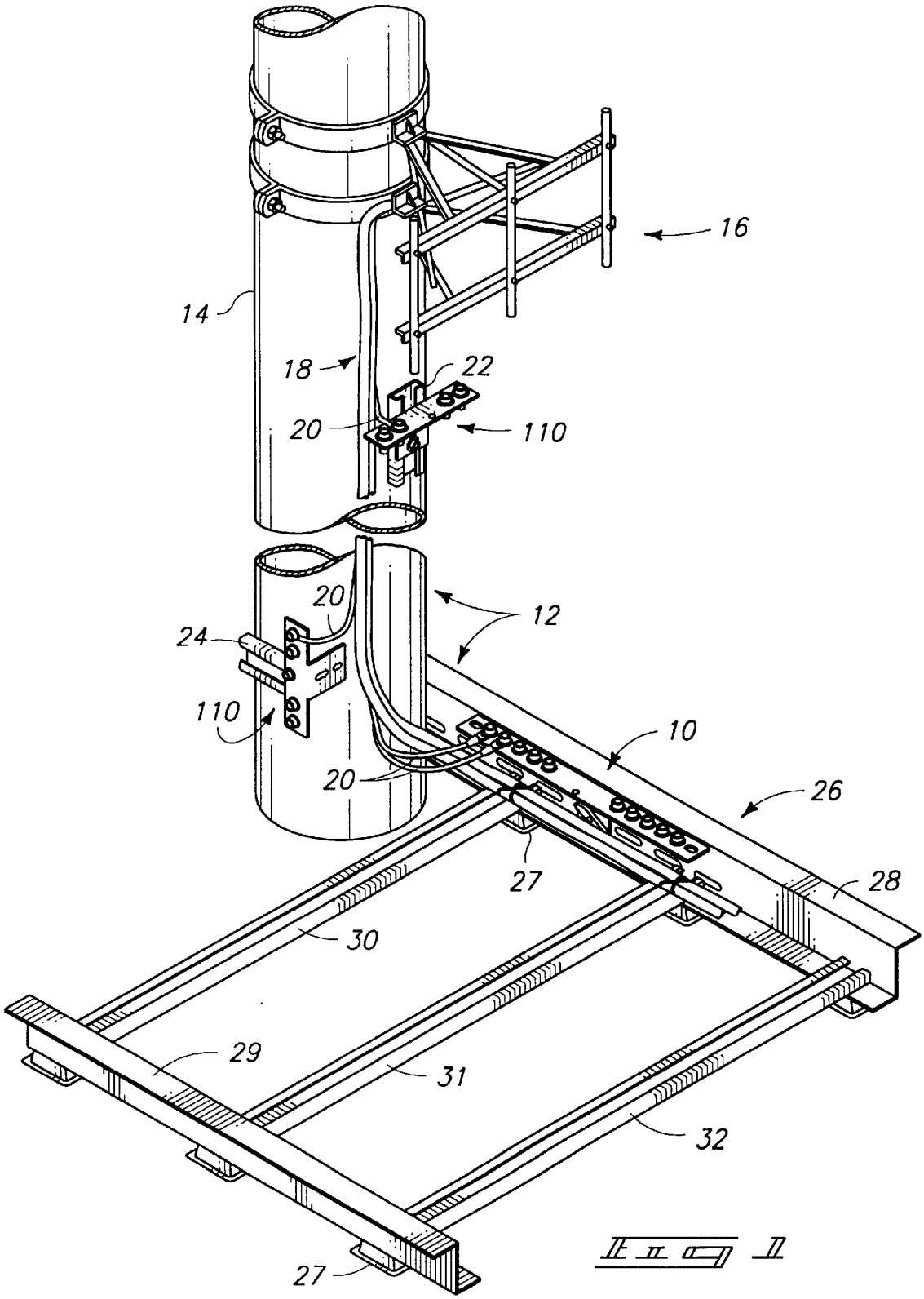
FIG. 1 is a partial breakaway perspective view of a wireless communication antenna system including an electrical support and ground assembly embodying features of the present invention.
Figure 2:
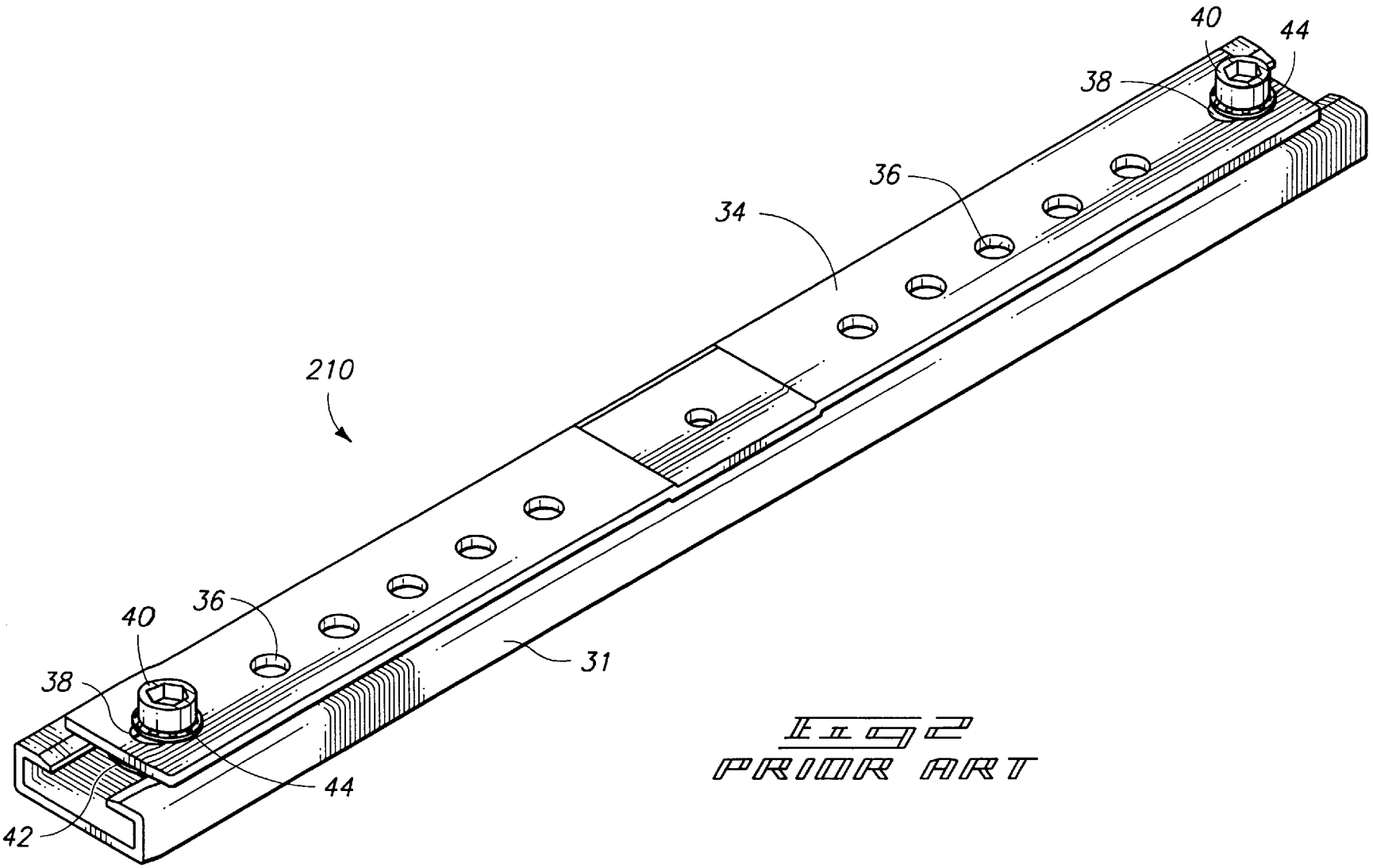
FIG 2 PRIOR ART
FIG. 2 is a perspective view of a prior art ground device which occupies a significant amount of mounting area, or footprint, on a c-profile.

Two preferred embodiments of the invention are illustrated in the accompanying drawings particularly showing an antenna component grounding system generally designated with reference numerals 10 and 110 in FIG. 1, and illustrating three distinct mounting configurations for grounding system 10. According to such two embodiments, grounding system 10 comprises an elongated version of grounding system 110. Grounding system 10 and grounding systems 110 are shown mounted in three distinct configurations, respectively, on an electrically-conductive support structure 12.

According to one construction, support structure 12 comprises a mast, or tower, 14 configured to support a plurality of antennas, such as a Groupe Speciale Mobile (GSM) antenna 16. A cable, or wire bundle, 18 is carried by support structure 12, wherein antenna 16 connects with cable 18, and a plurality of ground wires 20 are provided at dead ends and/or junction points along the antenna system and cable 18. Ground wires 20 are connected to grounding systems 10, 10' and 110 in order to mitigate electrical noise, protect personnel, provide power contact protection, and reduce lightning potentials such as from lightning surges wherein the surges are protected (or grounded) to ground before they reach any cable conductors and/or electronic equipment.

As shown in FIG. 1, ground wires 20 extend from cable 18 in order to provide a local ground onto mast 14 via c-profile 22 and c-profile 24, and onto a cable ladder ground kit 26 via a cable ladder 28. It is understood that c-profiles, or rails, 22 and 24 are each welded and/or clamped onto mast 14, wherein mast 14 and c-profiles 22 and 24 are formed from an electrically conductive material such as steel, copper, aluminum, or some other electrically conductive material.

As shown in FIG. 1, cable ladder 26 comprises a pair of cable ladder rails 28 and 29 between which a plurality of c-profiles 30–32 are rigidly affixed thereto at opposite ends. Typically, cable ladder 26 is supported atop a plurality of pads 27, wherein cable ladder 26 is further electrically connected to a ground system for a building, or to a ground stake that is embedded within the ground.

One suitable implementation for grounding system 10 comprises an antenna mast 14 provided atop a building, wherein cable ladder 26 is affixed to the roof of a building adjacent a base portion of mast 14. Cable ladder 26 provides cable ladder rails 28 and 29 and c-profiles 30–32 which facilitate grounding and support for a large number of cables 18 that are run from mast 14. Accordingly, and grounding capabilities are provided for a large number of antennas, such as antenna 16, that are mounted onto a single, common mast 14.

It is understood that a limited number of locations are available for mounting antennas at desirable locations atop elevated structures. For example, it is typically the case that the largest building within a city supports a relatively large number of antennas, which are crowded atop a handful of antenna masts provided thereon. Accordingly, cable ladder 26 becomes very crowded with cables and ground wires, and ground bars. Hence, there is a need to provide for increased capacity when supporting cable and grounding electrical components that are associated with an antenna structure and cabling system.

As shown in FIG. 1, two distinct embodiments for grounding system 10 and 110 are illustrated. Furthermore, grounding system 10 is shown mounted in one environment atop a cable ladder rail 28. Additionally, grounding systems 110 are shown mounted in a second mounting configuration and a third mounting configuration, respectively. The second mounting configuration is provided along a slot within a c-profile 22 on mast 14. The third configuration is provided on an end portion of a c-profile 24 also welded or affixed in electrically-conductive relation onto mast 14. Further details of such three placements are described below in greater detail with reference to FIGS. 3–14.

Figure 3:
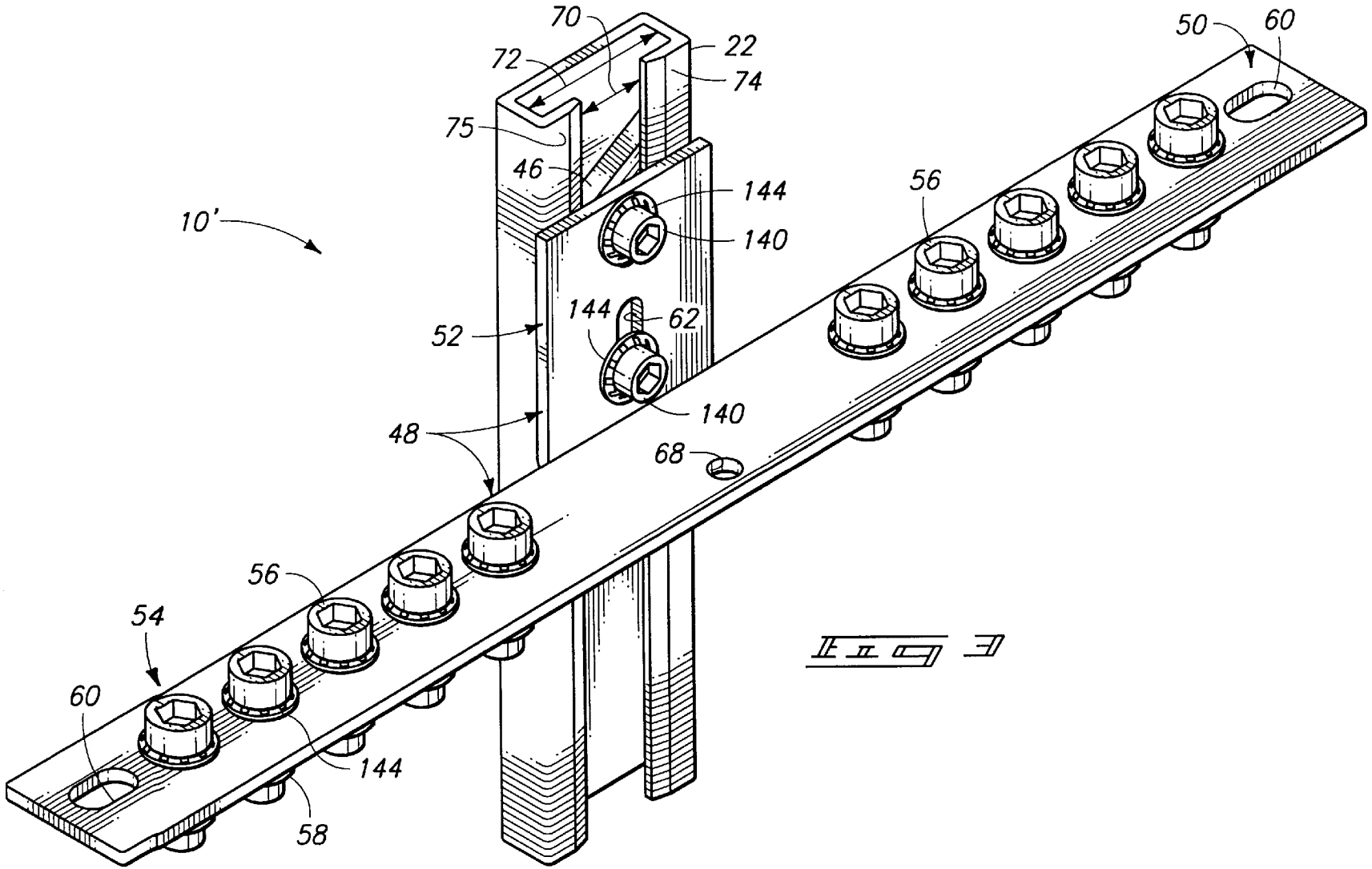
FIG. 3 is an enlarged perspective view of one grounding device showing a first mounting configuration on a c-profile.

FIG. 3 illustrates an alternative mounting configuration for a grounding system 10' constructed identically to the first embodiment grounding system 10 of FIG. 1. However, grounding system 10' is assembled together in a different manner than grounding system 10 (of FIG. 1), wherein grounding system 10' is shown mounted onto c-profile 22 (of FIG. 1). As shown in FIG. 3, grounding system 10' includes a pair of elongate backing, or retainer, plates 46 and an integrally formed ground bar 48. Further details of backing plates 46 are described below with reference to FIGS. 11 and 12. It is understood that plates 46 comprise camming plates according to one construction.

As shown in FIG. 3, ground bar 48 includes an elongate electrical contact bridge, or cross-member, 50 and a depending retainer bracket, or tab, 52 that angularly depends centrally of bridge 50. A plurality of electrical contacts 54 are provided in spaced-apart relation along bridge 50. A pair of elongated apertures 60 are also provided, one at each end of bridge 50. Each electrical contact 54 comprises an aperture 66 (see FIG. 4) within bridge 50; a threaded bolt, or fastener, 56; a nut 58; a pair of lock washers 144; a pair of washers 90 (see FIG. 8); and a nut 58.

According to one construction, washers 144 each comprise a toothed star washer. Alternatively, such washers 144 each comprise a lock washer. It is understood that a forked connector, or an eyelet connector, is provided on the end of each ground wire 20 (of FIG. 1) to facilitate electrical connection of ground wire 20 to bridge 50 by placing such connector between one associated pair of washers 144 and 90 (see FIG. 8).

It is also understood that ground bar 48 is securely retained in electrically-conductive relation onto c-profile 22 by cooperation in assembly between elongate backing plate 46 and retainer bracket 52. In assembly, c-profile 22 is trapped in electrically-conductive relation between elongate backing plate(s) 46 and retainer bracket 52 as fastener(s) 140 is/are secured to draw plate(s) 46 and bracket 52 (as well as ground bar 48) together. A pair of elongated apertures, or fastener receivers, 62 and 64 are provided in retainer bracket 52 to facilitate receipt of fasteners 140 which further engage with respective backing plates 46.

As shown in FIG. 3, a lock washer 144 is provided on each fastener 140 before receiving one of such fasteners in each elongated apertures 62 and 64, respectively. Fastener 140 then threads into engagement within elongate backing plate 46, wherein backing plate 46 contains a threaded aperture therein such that backing plate 46 also acts as a nut and washer when coacting with each threaded fastener 140.

Also shown in FIG. 3, an aperture 68 is provided centrally of bridge 50 to facilitate the mounting configuration depicted in FIG. 7. More particularly, according to such mounting configuration fastener 140 is received through aperture 68 to engage with an elongate backing plate 46 such that ground bar 48 can be mounted on an end of a c-profile 24 (see FIG. 7).

As shown in FIG. 3, c-profile 22 comprises an axially extending slot 70 having a dimension sized less than an inner wall track dimension 72 so as to define a pair of elongate side walls 74 and 75 extending there along on either side. As will be described below in greater detail with respect to FIGS. 13 and 14, slot 70 enables pre-assembly of grounding system 10 prior to mounting of grounding system 10 onto c-profile 22.

More particularly, a pair of elongate backing plates 46 are oriented 11 for insertion into slot 70, after which fasteners 140 are tightened, which causes rotation of elongate backing plates 46 sufficient to cause engagement of elongate backing plates 46 with inner walls that define track dimension 72. When elongate backing plates 46 rotate into engagement with the walls defining dimension 72 during threaded assembly of fasteners 140, elongate backing plates 46 cooperate with a back surface of retainer bracket 52 such that walls 74 and 75 are entrapped therebetween. Further tightening of fasteners 140 ensures electrically-conductive connection between ground bar 48 and c-profile 22.

Figure 4:
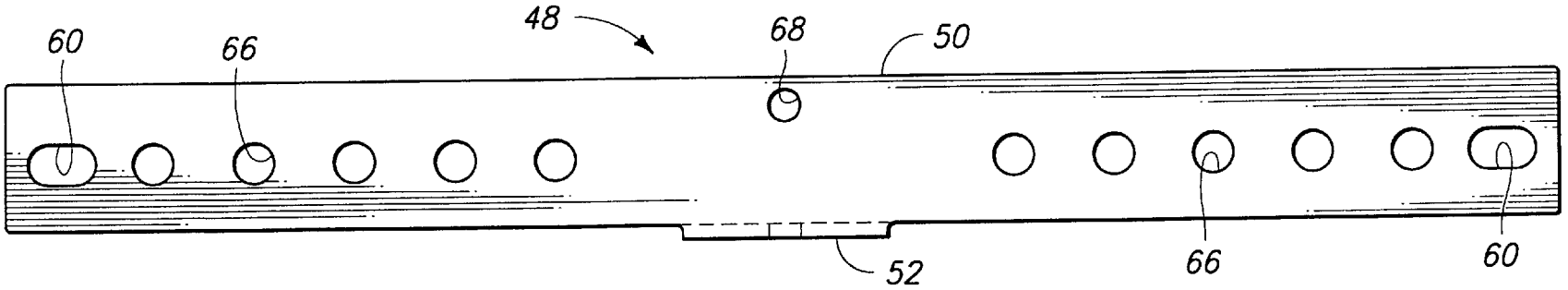
FIG. 4 is a top view of the grounding device of FIG. 3.
Figure 5:
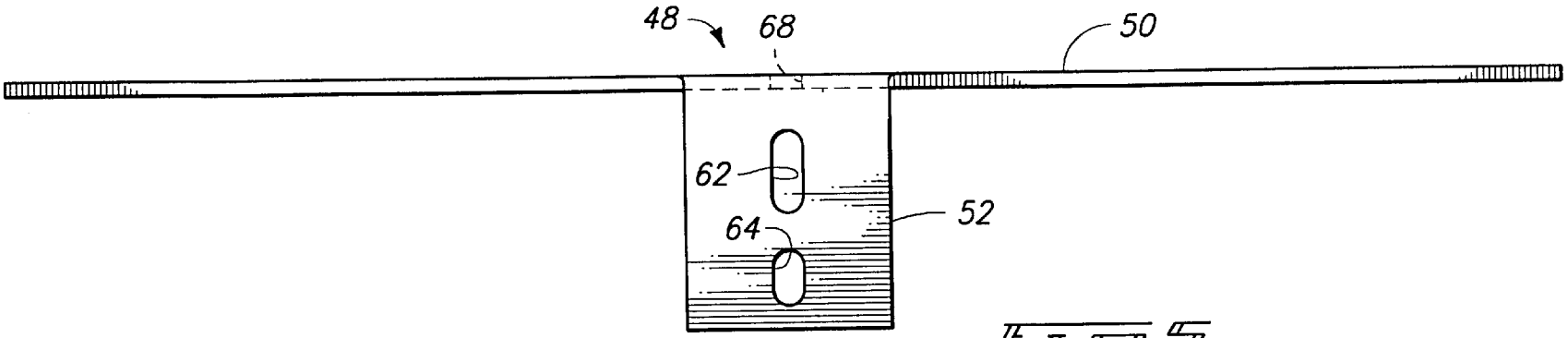
FIG. 5 is an elevational view of the grounding device of FIG. 3 showing one mounting surface.

As shown in FIGS. 4 and 5, a plurality of fastener apertures 66 are provided in bridge, or cross-member, 50 of ground bar 48 for receiving fasteners, or threaded bolts, 56 so as to form an electrical contact 56. Additionally, elongated aperture 60 can also be utilized to receive additional fasteners 56 (see FIG. 3) for additional mounting options and/or electrical contacts. Hence, a range of 1 to 12 electrical ground connections can be made onto bridge 50 according to the one embodiment and mounting configuration depicted in FIG. 3.

According to one construction, ground bar 48 of FIGS. 4 and 5 is formed from a 3 millimeter thick piece of stainless steel plate, wherein bridge 50 is 342 millimeters in length. Retainer bracket 52 is 55 millimeters is length, extending in a direction perpendicular to the length-wise axis of bridge 50.

Figure 6:
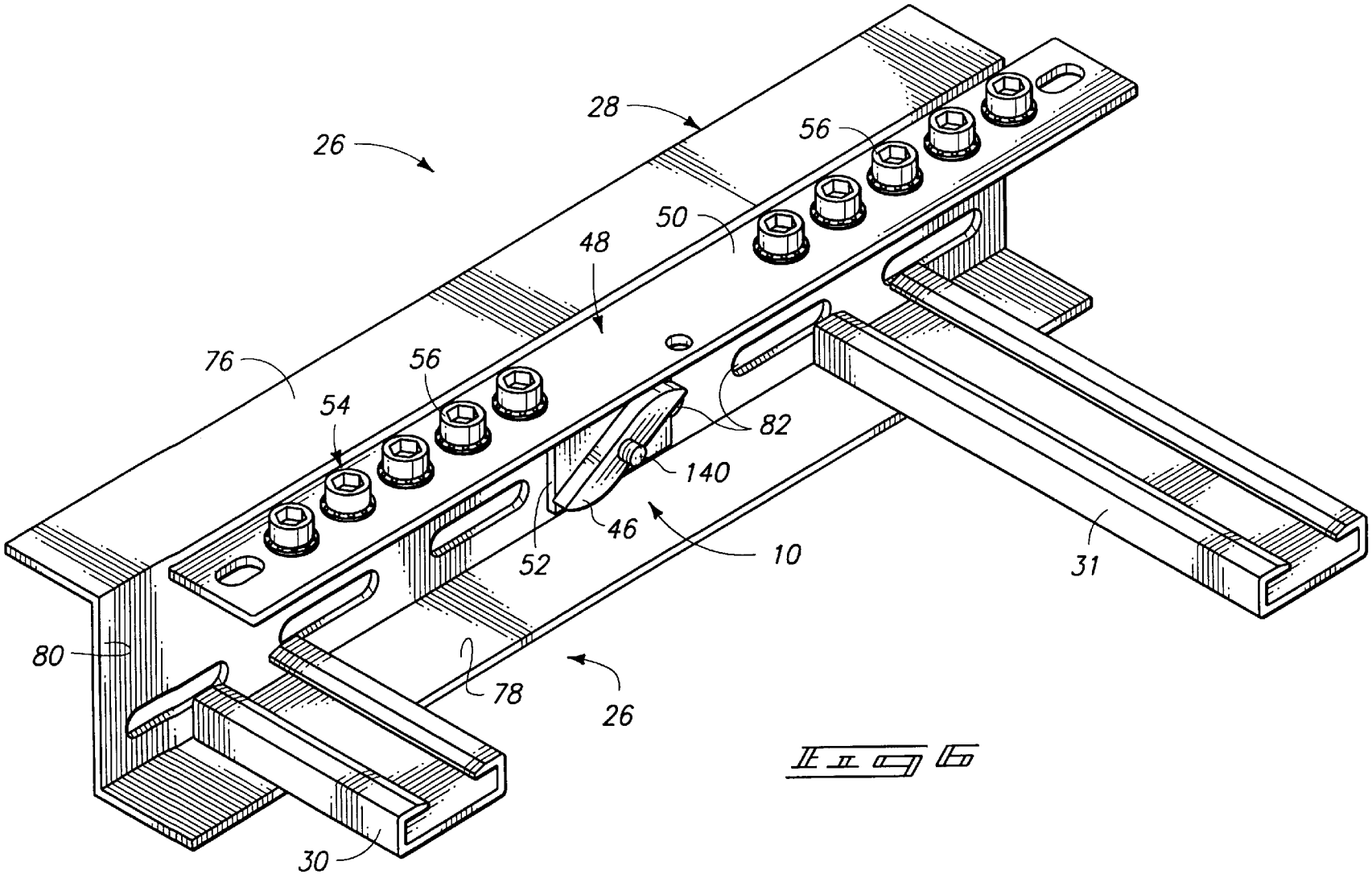
FIG. 6 is an enlarged perspective view of the grounding device of FIG. 3 showing a second mounting configuration on a cable ladder.

As shown in FIG. 6, grounding system 10 (of FIG. 1), including ground bar 48 (of FIGS. 3–4), is shown mounted in the one configuration depicted in FIG. 1. More particularly, in contrast to the mounting configuration of grounding system 10' (in FIG. 3), elongate backing plate 46 is received in direct abutment with retainer bracket 52 when mounting grounding system 10 onto a cable ladder rail 28 of a cable ladder 26. More particularly, fastener 140 is received through an elongated slot, or aperture, 82 provided on a vertical wall 80 of cable ladder rail 28. Cable ladder rail 28 further comprises a top flange 76 and a bottom flange 78 provided on opposite edges of vertical wall 80.

It is understood that fastener 140 passes through a back side of vertical wall 80 such that a head of fastener 140 and a lock washer (not shown) abut against a back face of vertical wall 80, wherein fastener 140 further passes through aperture 82 and elongated aperture 64 (see FIG. 5) of ground bar 48. Finally, fastener 140 further passes through elongate backing plate 46 which includes a threaded aperture therein sized to mate in engagement with a threaded end of fastener 140. Fastener 140 is then tightened utilizing a wrench, such as a hex-head wrench. Such tightening causes fastener 140 and elongate backing plate 46 to be drawn together so as to force retainer bracket 52 into positive, electrically-conductive engagement with vertical wall 80 of cable ladder rail 28.

Such mounting configuration for grounding system 10 is relatively flush with top flange 76, and furthermore provides room for the support 11 of cables below bridge 50 and atop c-profiles 30 and 32, against vertical wall 80. Accordingly, such construction provides a relatively compact support configuration for cables, while still providing for the attachment of up to 12 individual grounding wires onto bridge 50.

FIG. 7 illustrates alternative embodiment grounding system 110, similar to grounding system 10 (of FIGS. 1 and 3–6) but shortened in length suitable for more compact placements, and showing a third mounting configuration on an end portion of a c-profile 24. Further placement details of such third mounting configuration for grounding system 110 on c-profile 22 are depicted in FIG. 1. Further details of the construction of grounding system 110 are provided below with reference to FIG. 8. Additionally, further details of ground bar 148 of grounding system 110 are provided below with reference to FIGS. 9 and 10, and details of elongate backing plates 46 are provided below with reference to FIGS. 11 and 12.

As shown in FIG. 7, bridge 150 of ground bar 148 comprises an elongate cross-member having a pair of apertures 88 (see FIG. 7) on either end each sized to receive fasteners, in one case threaded bolts, 56. Accordingly, up to four electrical contacts 54 can be provided on bridge 150 via fasteners 56. Further details of each electrical contact 54 are provided with reference to FIG. 8.

More particularly, the third mounting configuration of FIG. 7 comprises receiving bridge 150 against an end portion 84 of c-profile 24. Aperture 68 (of FIG. 8) receives a single fastener, or threaded bolt, 140 that cooperates with a corresponding elongate backing plate 46 to entrap walls 74 and 75 between a bottom face of bridge 150 and elongate backing plate 46. Hence, ground bar 148 is electrically grounded in assembly to c-profile 24. Furthermore, an inner face of retainer bracket, or tab, 152 abuts with an end face of end portion 84 so as to prevent relative rotation and loosening between ground bar 148 and c-profile 24.

As was the case with grounding systems 10' (of FIG. 3) and 10 (of FIG. 6), each electrical contact 54 is configured to receive a ground wire 20 (of FIG. 1) in electrically conductive engagement therebetween. Optionally or additionally, oblong apertures 62 and 64 can be used to receive fasteners 56 and associated hardware (as shown in FIG. 8) to provide two more electrical contacts 54 on ground bar 148 when configured in such third mounting configuration.

Furthermore, according to one construction, a bottom face of bridge 150 and an inner face of retainer bracket 152 are ground after forming a right angle bend therebetween. Such finish operation serves to eliminate the presence of any radius bend therebetween and ensures the formation of a sharp angle that ensures good electrical fit-up and engagement between ground bar 48 and end portion 84 of c-profile 24. Such fit-up is important particularly where end portion 84 is formed by merely cutting c-profile at a right/angle using a cut-off saw. Optionally, ground bar 148 can be bent so as to eliminate the presence of a radius bend between bridge 150 and retainer bracket 152, or to cause such radius bend to be recessed from a right-angle intersection between the planes defining the bottom surface of bridge 150 and retainer bracket 152.

Figure 8:
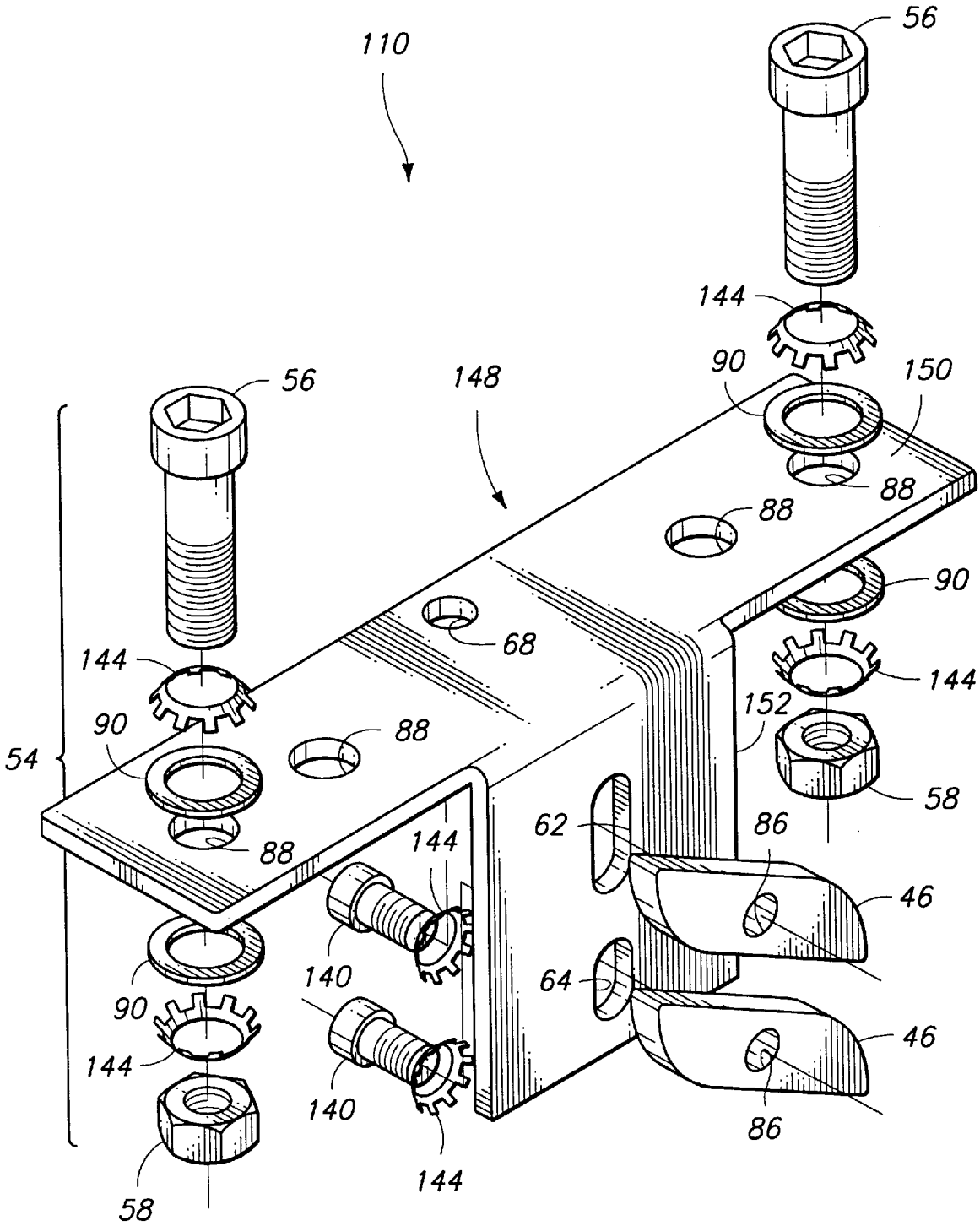
FIG. 8 is an exploded enlarged perspective view of the grounding device of FIG. 7 illustrating assembly components.
Figure 13:
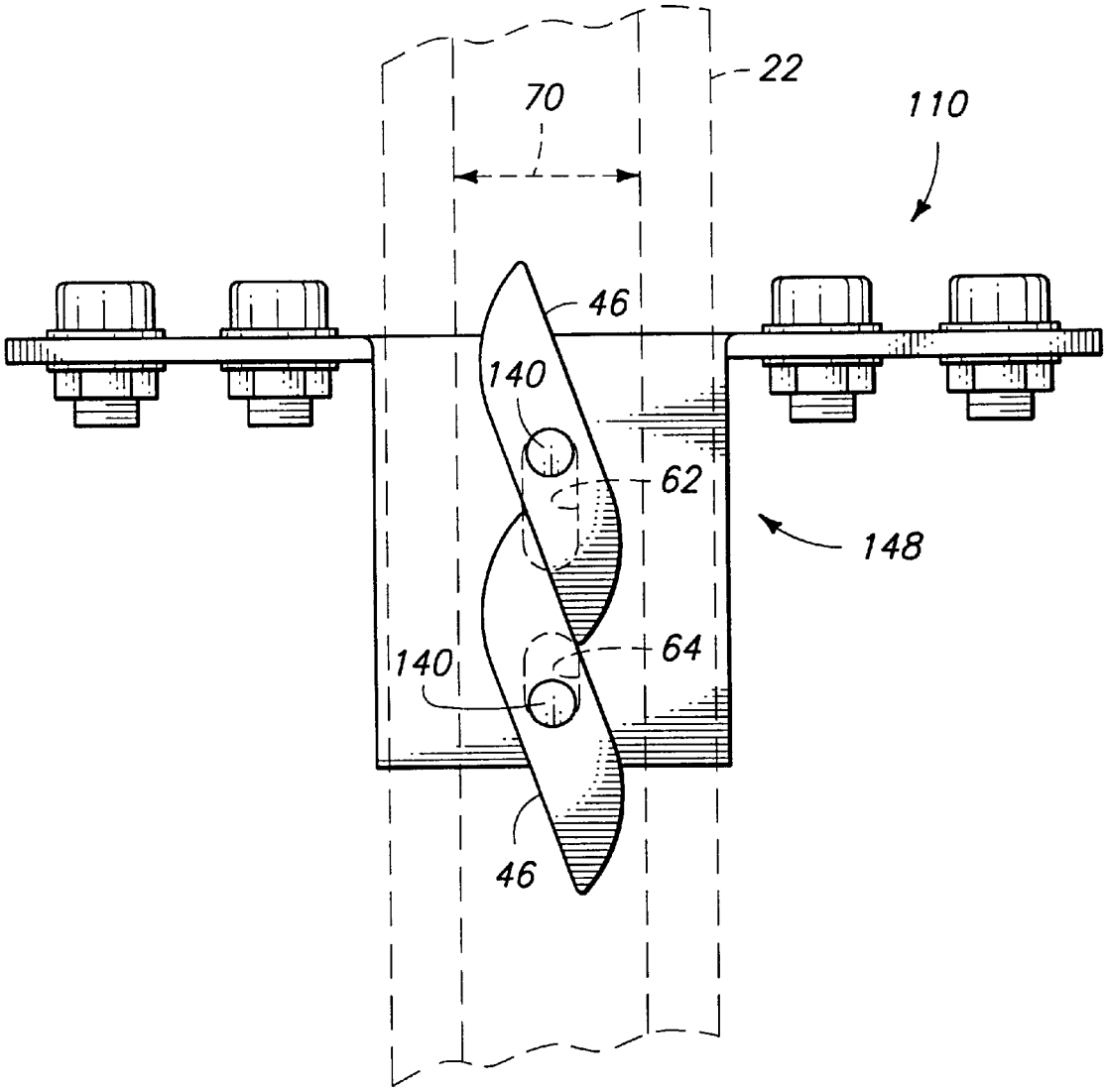
FIG. 13 is an elevational view of the grounding device of FIGS. 7–10 during assembly of the grounding device onto the first mounting configuration, or c-profile, of FIG. 3.
Figure 11A:
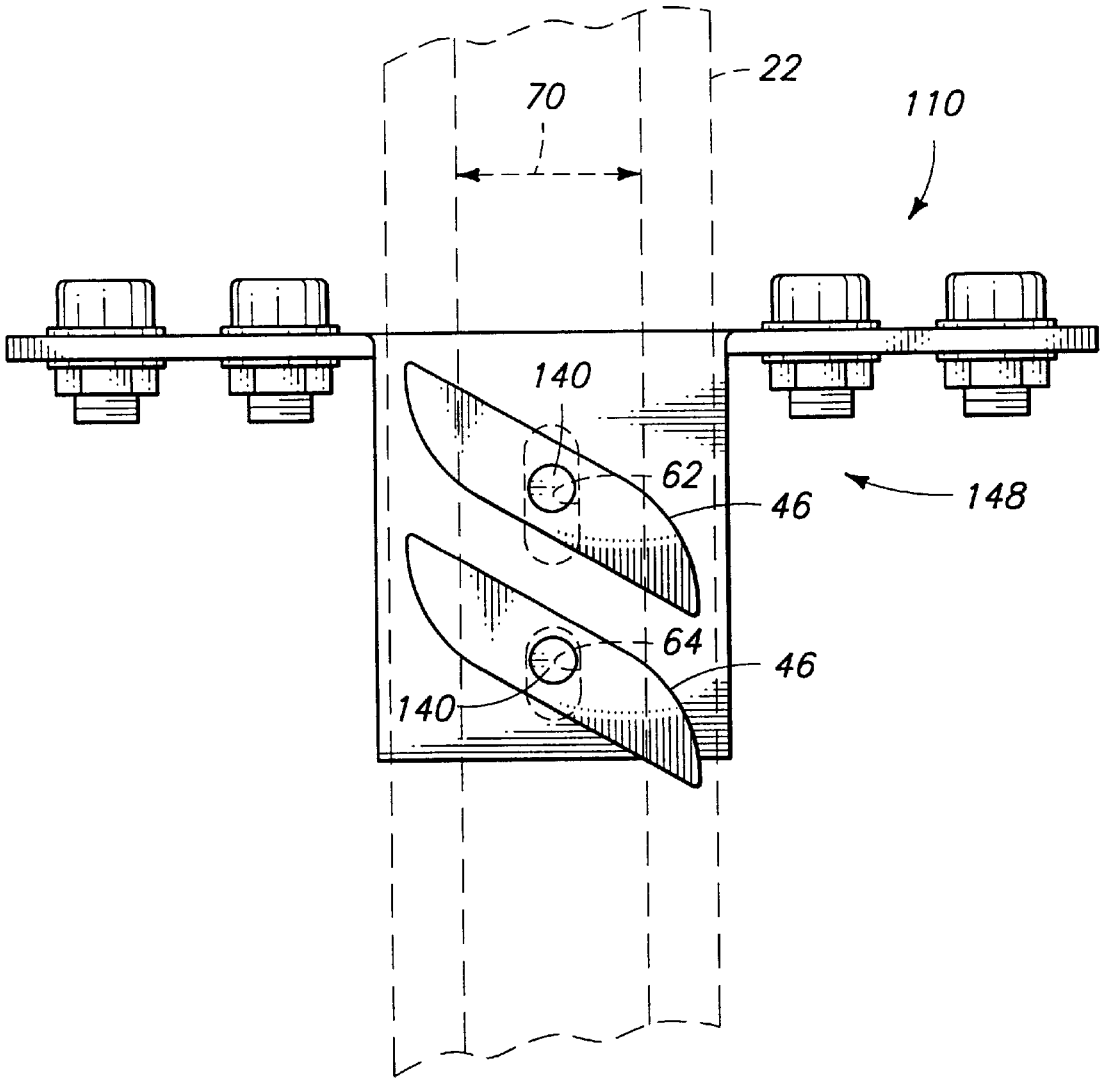

FIG. 8 illustrates in exploded perspective view the assembly components of grounding system 110 when assembling grounding system 110 to a c-profile 24 (of FIG. 1), as shown in FIGS. 13 and 14, and similar to the assembly of grounding system 10' to c-profile 24 (in FIG. 3). More particularly, the components of electrical contact 54 as used on grounding systems 10, 10' and 110 (of FIGS. 1, 3, 6 and 7) in all three mounting configurations are clearly shown in FIG. 8.

Each electrical contact 54 provides an electrical wire attachment point comprising a receiving aperture 88 provided in bridge 150 of grounding bar 148; a fastener, or threaded bolt, 56; a pair of lock washers 144, each in the form of a toothed star washer; a pair of washers 90; and a complementary threaded nut 58. In assembly, an electrical connector such as a y-shaped fork connector and/or a ring-shaped connector on a ground wire is received between the top lock washer 144 and washer 90 on each fastener 56. Accordingly, electrical contact is made between the ground wire and ground bar 48 via electrical contact 54.

Additionally, electrical contact is made between ground bar 48 and a support structure (such as a c-profile and/or a cable ladder) via assembled cooperation between fasteners 140, lock washers 144, retainer bracket 152 and elongate backing plate 46. Apertures 62 and 64 are preferably elongated in order to facilitate rotatable and sufficiently nested positioning of adjacent elongate backing plates 46 into a nested configuration (as shown in FIG. 13) sufficient to enable insertion of elongate backing plates 46 into a variety of variously sized slots on a number of different c-profiles. Furthermore, such elongation of apertures 62 enables mounting to variously sized cable ladders having a diverse range of aperture sizes and locations.

Figure 9:
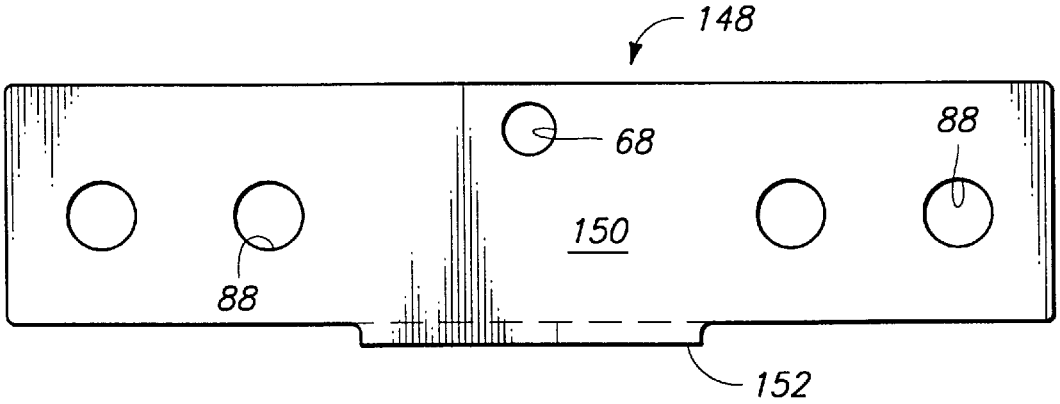
FIG. 9 is a top view of the grounding device of FIG. 8.
Figure 10:
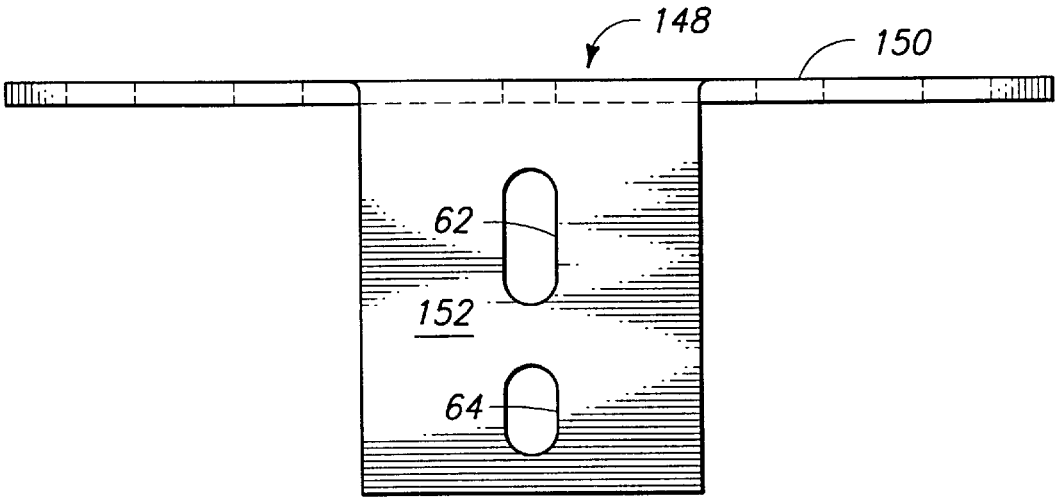
FIG. 10 is an elevational view of the grounding device of FIG. 8 showing one mounting surface.
Figure 11:
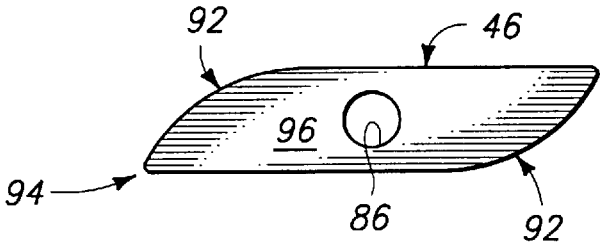

FIGS. 9 and 10 illustrate the construction of ground bar 148. More particularly, the configuration of apertures 88 along bridge 150 is shown there along. Furthermore, the placement of elongated apertures 60 and 62 is along apparent. Although bridge 150 and retainer bracket 152 are configured at a right angle to each other, it is understood that other angles can be formed therebetween.

According to one construction, ground bar 148 of FIGS. 9 and 10 is formed from a 3-millimeter thick piece of stainless steel plate, wherein bridge 150 is 138 millimeters in length. Retainer bracket 152 is 55 millimeters is length, extending in a direction perpendicular to the length-wise axis of bridge 150.

Figure 11:
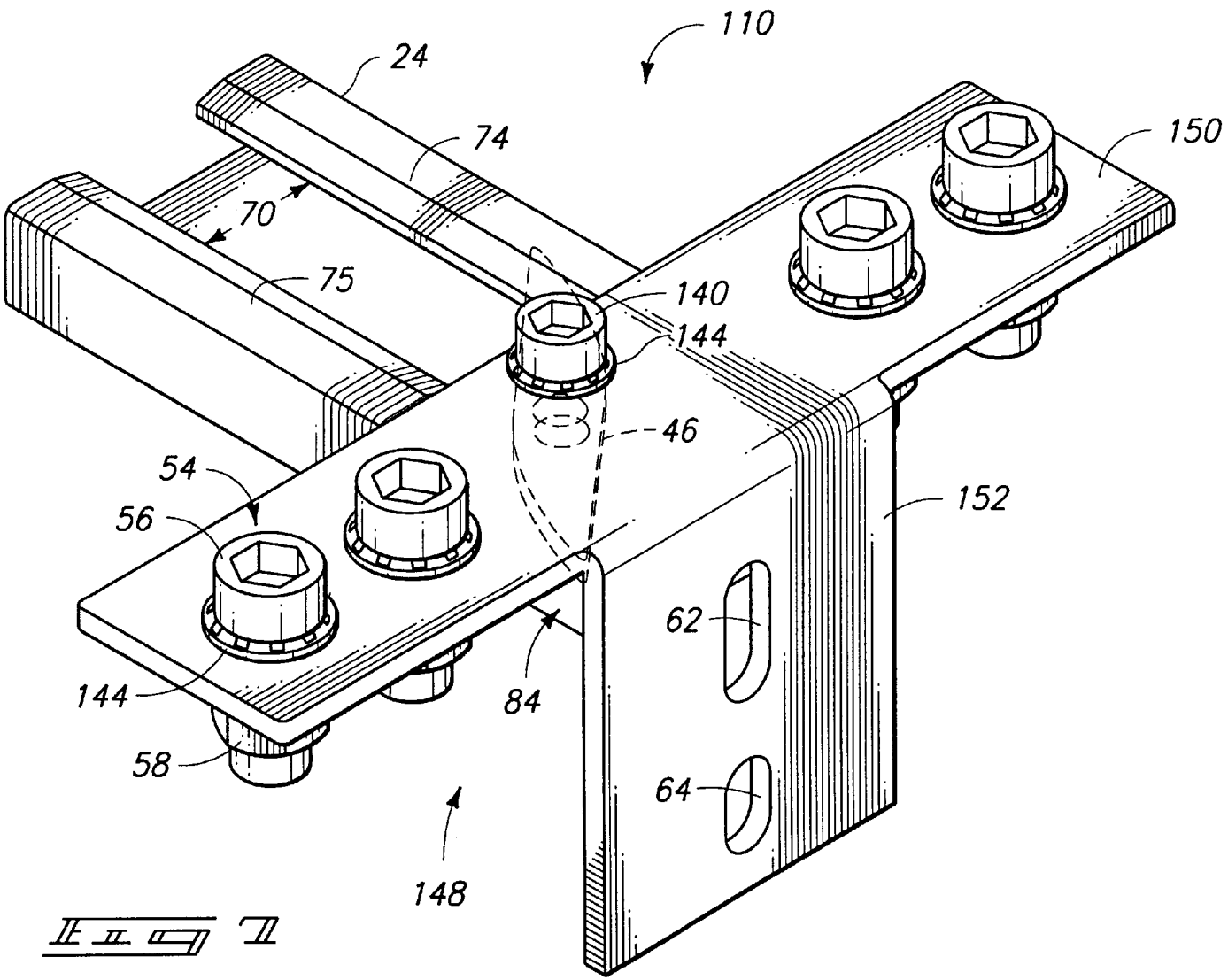
FIG. 11 is a plan view of a retainer plate used with the grounding devices of FIGS. 1–10.
Figure 12:
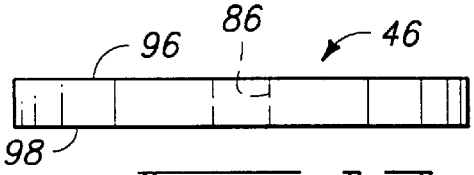
FIG. 12 is an elevational edge view of the retainer plate of FIG. 11.

FIGS. 11 and 12 illustrate one construction for elongate backing, or camming, plates 46. More particularly, backing plate 46 is shown in the form of an elongate backing plate having a fastener receiver in the form of a threaded aperture 86 sized to mate in complementary engagement with threads on fastener 140 (see FIG. 8). Elongate backing plate 46 has symmetric top and bottom faces 96 and 98 such that elongate backing plate 46 can be oriented during assembly with either face 96 and 98 toward ground bar 48 (see FIG. 8).

According to one construction, elongate backing plate 46 is machined from a 5-millimeter thick plate of stainless steel having a length of 48 millimeters. Aperture 86 is threaded to receive a metric #6 fastener, and a pair of arcuate edges 92 each form camming surfaces having a radius of 19 millimeters. However, it is understood that other shapes can be used to form elongate backing plate 46.

Arcuate edges 92 facilitate insertion of elongate backing plates 46 into a relatively narrow slot 70 of a c-profile (see FIG. 13) when grounding system 110 is pre-assembled. Additionally, arcuate edges 92 provide increased retention strength between grounding system 110 and s a support structure, as arcuate edges 92 present a larger portion of elongate backing plate 46 into engagement with such support structure. For example, if elongate backing plate 46 (of FIG. 14) had rectangular corners, a much smaller portion of elongate backing plate 46 would be trapped within c-profile 22, which would significantly reduce the assembled strength.

FIG. 13 illustrates the insertion of elongate backing plates 46 for a pre-assembled grounding system 110 into a slot 70 of a c-profile 22 (shown in phantom view). Elongated slots 62 and 64 facilitate parallel, nested together alignment of elongate backing plates 46, which enables insertion of such backing plates 46 through slot 70. Following such insertion, elongate backing plates 46 are rotated into the configuration depicted in FIG. 14.

FIG. 14 illustrates elongate backing plates 46 rotated within slot 70 following insertion of elongate backing plates 46 through slot 70 (as shown in FIG. 13). More particularly, elongate backing plates 46 are rotated in response to rotation of fasteners 140 when further threading together each fastener 140 and threaded elongate backing plate 46. Such threading causes elongate backing plate 46 to rotate such that each arcuate edge 92, or an outer end portion of elongate backing plate 46, abuts into engagement with an inner wall within c-profile 22.

As shown in FIG. 14, elongate backing plates 46 are shown assembled together with fasteners and ground bar 148, even though an arcuate edge or an end portion of each elongate backing plate 46 is not engaged with an inner wall of c-profile 22. Hence, it is understood that such abutment feature is not necessary to realize the benefits of Applicant's invention, although in some cases, such abutment feature is desirable to enhance assembled strength and to facilitate threading between each backing plate and associated fastener.

In compliance with the statute, the invention has been described in language more or less specific as to structural and methodical features. It is to be understood, however, that the invention is not limited to the specific features shown and described, since the means Is herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electrical component grounding device, comprising:

a ground bar including an elongate electrical contact bridge having at least one electrical contact, a retainer bracket angularly depending centrally of the bridge, and a pair of fastener receivers;

a pair of fasteners, each fastener communicating with the ground bar via a respective one of the fastener receivers; and a pair of elongate backing plates, each plate having a fastener receiver mating with a respective one of the fasteners and operative to engage together the ground bar and the backing plate about a support structure;

wherein the elongate backing plates and the fasteners further cooperate to support each of the backing plates for rotatable positioning relative to the ground bar to facilitate assembly of the grounding device to the support structure.

2. The grounding device of claim 1 wherein the electrical contact bridge comprises an electrically conductive cross-member, and the retainer bracket comprises a flange provided medially of and extending transversely at a substantially right angle from the cross-member.

3. The grounding device of claim 2 wherein the fastener receiver of the ground bar comprises an aperture extending through the retainer bracket and sized to receive the respective fastener.

4. The grounding device of claim 2 wherein the fastener receiver of the ground bar comprises an aperture provided through a central portion of the cross-member and sized to receive the fastener for mating to a support structure, and wherein the retainer bracket abuts in assembly with the support structure to prevent rotation of the grounding device relative to the support structure.

5. The grounding device of claim 4 wherein the support structure comprises an end portion of a C-rail, and wherein the retainer bracket is assembled in abutment with the end portion so as to prevent rotation of the grounding device.

6. The grounding device of claim 2 wherein the fasteners each comprise a bolt, and the elongate backing plates each comprise a threaded aperture configured to receive a complementary threaded leading end of the bolt, and wherein a head of the bolt opposite the leading end seats against the ground bar fastener receiver.

7. The grounding device of claim 1 wherein the elongate backing plate comprises an arcuate engaging edge provided at each end of the backing plate, and wherein the backing plate is rotatably positionable for insertion within a slot of a C-rail and thereafter rotatably positionable for capture within the C-rail, wherein the engaging edge abuts an inner wall of the C-rail, and wherein securement of the fastener secures the device to the C-rail.

8. The grounding device of claim 1 wherein each of the elongate backing plates comprises at least one engaging edge adjacent an end of the backing plate, the backing plate comprises a threaded fastener receiver sized to receive a threaded fastener, the ground bar, the fasteners and the backing plates are configured for mounting onto a cable ladder rail of an antenna electrical system, and the engaging edge engages in assembly with a flange of the cable ladder rail to restrain rotation of the respective backing plate while threading the respective fastener therein.

9. The grounding device of claim 1 wherein the contact bridge comprises a conductive cross-member having a plurality of spaced-apart apertures, each sized to receive a ground wire fastener.

10. The grounding device of claim 9 further comprising a plurality of ground wire fasteners, each configured for assembly within one of the apertures and operative to secure an electrical ground wire to the ground bar.

11. The grounding device of claim 9 wherein the ground bar is secured in electrically conductive engagement with a conductive support structure via securement of the fasteners, the ground bar, and the elongate backing plates to the support structure.

12. The grounding device of claim 11 wherein the pair of fastener receivers is provided in the retainer bracket.

13. An electrical system grounding and support apparatus, comprising:

an electrically conductive grounding bracket including an elongate cross-member having a plurality of electrical contacts for receiving ground wires and a mounting tab depending from the cross-member, a pair of spaced-apart apertures provided in the tab;

a pair of fasteners each cooperating with the grounding bracket to secure the grounding bracket in electrically conductive relation with a ground support structure; and a pair of elongate backing plates each carried In rotatable relation with the grounding bracket via one of the fasteners.

14. The apparatus of claim 13 wherein, in assembly, the elongate backing plates are rotatable between an adjacent, retaining position so as to facilitate assembly within a slot of a structural member.

15. The apparatus of claim 13 wherein the fastener comprises a threaded bolt and each elongate backing plate comprises a central, threaded aperture configured to receive one of the threaded bolts.

16. The apparatus of claim 15 wherein each of the elongate backing plates further comprises an arcuate edge portion along each end, at least one of the edge portions engagable upon assembly in rotation of the backing plate with the support structure to retain rotation of the backing plate during assembly.

17. An antenna component grounding system, comprising:

a ground bar having an elongate electrical contact portion for providing electrical contact for an antenna systems component and a mounting portion depending integrally from the electrical contact portion for retaining the ground bar to an electrically conductive support structure; and a pair of elongate retainer plates carried by the ground bar;

wherein the ground bar and the retainer plates cooperate to capture a support structure therebetween such that the support structure carries the grounding system.

18. The grounding system of claim 17 wherein the electrical contact portion comprises a conductive cross-member, and the mounting portion comprises a mounting bracket depending from the cross-member.

19. The grounding system of claim 18 wherein the mounting bracket is provided centrally of the cross-member and extends at a substantially right angle therefrom.

20. An electrical component grounding device, comprising:

a ground bar including a retainer bracket and a plurality of fastener receivers, the ground bar configured to electrically connect with at least one ground wire;

a plurality of fasteners each communicating with the ground bar via a respective one of the fastener receivers; and a plurality of elongate plates each having a plate fastener receiver sized to mate with a respective one of the fasteners, each fastener operative to secure together the ground bar and the respective backing plate about a support structure.

21. The grounding device of claim 20 wherein the ground bar comprises an elongate electrical contact bridge having a plurality of spaced-apart apertures each configured to receive a ground wire attachment.

22. The grounding device of claim 21 wherein the ground bar further comprises a retainer bracket portion angularly extending centrally of and integrally from the contact bridge.

23. The grounding device of claim 22 wherein one fastener receiver is provided along a distal end-portion of the elongate electrical contact bridge and at least one fastener receiver is provided in the retainer bracket portion.

24. The grounding device of claim 23 wherein a pair of the fasteners receivers are provided in the retainer bracket portion for affixing the grounding device to a support structure.

25. The grounding device of claim 22 wherein the one fastener receiver is provided in the elongate electrical contact bridge so as to impart a first mounting location for mounting the grounding device to a support structure in a first mounting configuration, and the at least one fastener receiver is provided in the retainer bracket portion so as to impart a second mounting location for mounting the grounding device to a support structure in a second mounting configuration.

26. An electrical component grounding device, comprising, a ground bar having a pair of fastener receivers;

a pair of fasteners each cooperating with the ground bar; and a pair of elongate backing plates each cooperating with one of the fasteners to secure the ground bar to a support structure.

27. The device of claim 20 wherein each of the elongate backing plates further comprises an arcuate edge portion along each end, at least one of the edge portions engagable upon assembly in rotation of the backing plate with the support structure to retain rotation of the backing plate during assembly.

28. The device of claim 20 wherein the ground bar further comprises a retainer bracket portion angularly extending centrally of the contact bridge.

29. The device of claim 28 wherein the retainer bracket is configured to cooperate with a support structure such that the ground bar resists rotation relative to the support structure.

30. The apparatus of claim 26 wherein, in assembly, the elongate backing plates are each rotatable between an adjacent, nested position and a retaining position so as to facilitate assembly within a slot of a structural member.

31. The apparatus of claim 26 wherein the fastener comprises a threaded bolt and each elongate backing plate comprises a central, threaded aperture configured to receive one of the threaded bolts.

32. A ground bar, comprising:

an elongate, electrical contact bridge having a plurality of electrical contacts provided there along;

a retainer angularly depending centrally of the contact bridge and formed integrally therewith;

a fastener receiver provided in the elongate, electrical contact bridge configured to provide a first mounting location for mounting of the ground bar in a first mounting configuration to a support structure; and another fastener receiver provided in the depending retainer and configured to provide a second mounting location for mounting the ground bar in a second mounting location to a support structure.

33. The ground bar of claim 32 wherein the first fastener receiver comprises an aperture provided in the elongate contact bridge.

34. The ground bar of claim 33 wherein the aperture comprises an elongate aperture.

35. The ground bar of claim 33 wherein the aperture is provided adjacent one and of the electrical contact bridge.

36. The ground bar of claim 33 wherein the one aperture is provided centrally of the electrical contact bridge.

37. The ground bar of claim 32 wherein the second aperture comprises a pair of apertures provided in the depending retainer.

38. The ground bar of claim 37 wherein the pair of apertures comprises a pair of elongate apertures each configured to receive retaining fasteners in adjustable relation there along.

* * * * *

UNITED STATES PATENT AND TRADEMARK OFFICE

CERTIFICATE OF CORRECTION

PATENT NO. : 6,431,885 B1
DATED : August 13, 2002
INVENTOR(S) : Paul Stroup

It is certified that error appears in the above-identified patent and that said Letters Patent is hereby corrected as shown below:

Column 1,
Line 66, delete “capture bar 34 11 about”, and insert -- capture bar 34 about --.

Column 4,
Line 51, delete “Accordingly, and grounding capabilities”, and insert
-- Accordingly, grounding capabilities --.

Column 6,
Line 8, delete “oriented 11 for insertion”, and insert -- oriented for insertion --.
Line 63, delete “the support 11 of cables”, and insert -- the support of cables --.

Column 8,
Line 25, delete “is along apparent”, and insert -- is also apparent. --.
Line 44, delete “face 96 and 98”, and insert -- face 96 or 98 --.
Line 56, delete “and s a support”, and insert -- and a support --.

Column 9,
Line 29, delete “the means Is herein”, and insert -- the means herein --.

Column 10,
Line 57, delete “carried In rotatable”, and insert -- carried in rotatable --.

Column 11,
Line 51, delete “fasteners receivers are provided”, and insert
-- fastener receivers are provided --.

Signed and Sealed this

Eleventh Day of February, 2003

JAMES E. ROGAN
*Director of the United States Patent and Trademark Office*